US006553204B1

(12) United States Patent
Yamada

(10) Patent No.: US 6,553,204 B1
(45) Date of Patent: Apr. 22, 2003

(54) FIXING DEVICE FOR FIXING A TONER IMAGE IN AN IMAGE FORMING APPARATUS

(75) Inventor: Masamichi Yamada, Yokohama (JP)

(73) Assignee: Ricoh Company, Ltd., Tokyo-to (JP)

( * ) Notice: Subject to any disclaimer, the term of this patent is extended or adjusted under 35 U.S.C. 154(b) by 0 days.

(21) Appl. No.: 09/614,731

(22) Filed: Jul. 12, 2000

(30) Foreign Application Priority Data

Jul. 23, 1999 (JP) ..... 11-208686

(51) Int. Cl.[7] ..... G03G 15/20

(52) U.S. Cl. ..... 399/328; 219/216; 399/122; 399/329

(58) Field of Search ..... 399/320, 328, 399/329, 330, 331, 122; 219/216, 469–471

(56) References Cited

U.S. PATENT DOCUMENTS 4,231,653 A * 11/1980 Nagahara et al. ..... 219/216 X
5,572,307 A * 11/1996 Tomatsu et al. ..... 399/331
6,091,926 A * 7/2000 Yamada ..... 399/329
6,134,400 A * 10/2000 Higashi et al. ..... 399/328 X
6,137,984 A * 10/2000 Higashi et al. ..... 399/329
6,181,891 B1 * 1/2001 Higashi et al.

FOREIGN PATENT DOCUMENTS

JP 9-160410 6/1997
JP 11-224011 8/1999

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

An image forming apparatus and a fixing device for fixing a toner image on a transfer member include a fixing roller and a backup roller configured to press the image transfer member against the fixing roller, wherein either one of a circumferential hardness of the fixing roller and a circumferential hardness of the backup roller is configured to be harder than that of the other roller. The image forming apparatus and the fixing device further include a first gear coaxially mounted on the roller having the harder circumferential surface, a one-way clutch coaxially mounted on the other roller, and a second gear coaxially mounted on the one-way clutch. The first gear and the second gear are configured to be engaged when the backup roller presses the image transfer member against the fixing roller, and one of the first gear and the second gear is driven by a drive motor. Further, the backup roller and first gear are configured to be open relative to the fixing roller, the fixing roller being fixed in position for a maintenance operation. Also, a heating device may be provided to directly contact an outer surface of the fixing roller.

7 Claims, 9 Drawing Sheets

FIXING DEVICE FOR FIXING A TONER IMAGE IN AN IMAGE FORMING APPARATUS

BACKGROUND OF THE INVENTION

1. Field of the Invention

The present invention relates to an image forming apparatus, such as a laser beam printer, a photocopier, a plain paper facsimile machine, etc., and a toner image fixing device.

2. Discussion of the Background

As an example of fixing devices for fixing a toner image on an image transfer sheet such as a sheet of paper as a permanent fixed image, a heat roller fixing device is widely used.

FIG. 1 is a schematic view illustrating a heat roller fixing device as an example of background art. The heat roller fixing device of FIG. 1 is typically used for fixing a relatively thick toner image, such as a fixed toner image required to be glossy such as a full color toner image. Referring to FIG. 1, the heat roller fixing device provides a fixing roller module 5, a backup roller module 6, a cleaning roller 13, and an oil coating roller 14. The fixing roller module 5 includes a halogen heater 1 as a heat source, a fixing roller having a hollow metal core 2, an elastic layer 3 on the hollow metal core 3, and a release agent layer 4 as the outermost layer. Similarly, the backup roller module 6 includes a halogen heater 7 as a heat source, a backup roller having a hollow metal core 8, an elastic layer 9 on the hollow metal core 8, and a release agent layer 10 as the outermost layer. The halogen heater 7 in the backup roller is optional and may be omitted.

An image transfer sheet 12 bearing a toner image 11 is transported into a nip formed between the fixing roller module 5 and the backup roller module 6, and the toner image 11 is softened or melted and fixed onto the image transfer sheet 12 by heat and pressure by the fixing roller and the backup roller. The cleaning roller 13 contacts the fixing roller module 5 to remove toner adhered on the surface of the fixing roller module 5. The oil coating roller 14 also contacts the fixing roller module 5 to apply oil as a release agent to the surface of the fixing roller module 5 to prevent the image transfer sheet 12 from twining around the fixing roller module 5. The oil also prevents the melted or softened toner from adhering to the fixing roller module 5.

Overlaying four color toners at most, such as of cyan, magenta, yellow, and black toners, generally forms a full color image. To form a quality image, color toners are sufficiently melted and fixed so that each color toner can transmit a specific spectrum of light and thereby a merged spectrum generates a preferable color. For that reason, the hollow metal core 2 of the fixing roller module 5 is sometimes structured to have a large amount of heat capacity, and the elastic layer 3 is structured to sandwich the toner image 11 together with the backup roller module 6 for supplying sufficient heat.

The heat roller fixing device of FIG. 1 generally uses a relatively large amount of release agent because of a relative high temperature of the heat roller. However, when such a relatively large amount of the release agent is applied to the fixing roller module 5, the release agent generates a sludge-like mixture together with toner powders adhered on the fixing roller module 5, fiber and/or dust of paper, calcium carbonate, etc. Such a sludge-like mixture sometimes soils the fixing device, and may also soil the hands of a user or a service person of the image forming apparatus in which the fixing device of FIG. 1 is installed during a replacement operation of expendable equipment, such as the oil coating roller 14. The sludge-like mixture sometimes also hampers workability of the replacing operation of the expendable equipment as well. Therefore, a demand for a fixing device that uses a relatively small quantity of release agent in comparison with the background art is increasing.

As another example, Japanese Laid Open Patent No. 9-160410 describes an image forming apparatus installed with a fixing device having a heat roller pair constructed by a fixing roller and a backup roller. Each roller of the heat roller pair has a gear as a single piece on an axis. The fixing device also provides a belt, spanning parts for spanning and driving the belt, a belt charging device, a belt discharging device, and a preliminary heating device upstream from the heat roller pair. The fixing device further provides a motor for driving each of the heat roller pair via the gears and the preliminary heating device.

In this example, additional elements, such as the belt, the spanning parts, the preliminary heat source, the belt charging device, etc., are required, and therefore the production costs may increase. Further, each roller of the heat roller pair is driven via the gears fixed to the rollers by the single motor, so that an error in hardness of the elastic layer and/or an error of a diameter thereof may cause a difference between the surface velocities of the rollers. Consequently, such a difference between surface velocities may cause an image transfer sheet to become crinkled.

SUMMARY OF THE INVENTION

The present invention has been made in view of the above-discussed and other problems and has as one objective to overcome the above-discussed and other problems associated with the background methods and apparatus. Accordingly, one object of the present invention is to provide a novel image forming apparatus and a novel fixing device that can fix toner images on a image transfer sheet without release agent or with a relatively small quantity of release agent.

Another object of the present invention is to provide a novel image forming apparatus and a novel fixing device that can decrease chances of an image transfer sheet becoming crinkled.

A further object of the present invention is to provide a novel image forming apparatus and a novel fixing device that can reach a ready-to-fix state in a relatively short time.

To achieve these and other objects, the present invention provides a novel image forming apparatus and a novel fixing device including a fixing roller and a backup roller configured to press the image transfer sheet against the fixing roller, wherein either one of the circumferential hardness of the fixing roller and the circumferential hardness of the backup roller is configured to be harder than the other. The image forming apparatus and the fixing device further include a first gear coaxially mounted on the roller having the harder circumferential surface, a one-way clutch coaxially mounted on the other roller, and a second gear coaxially mounted on the one-way clutch. The first gear and the second gear are configured to be engaged when the backup roller presses the image transfer sheet against the fixing roller, and one of the first gear and the second gear is driven by a power source.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
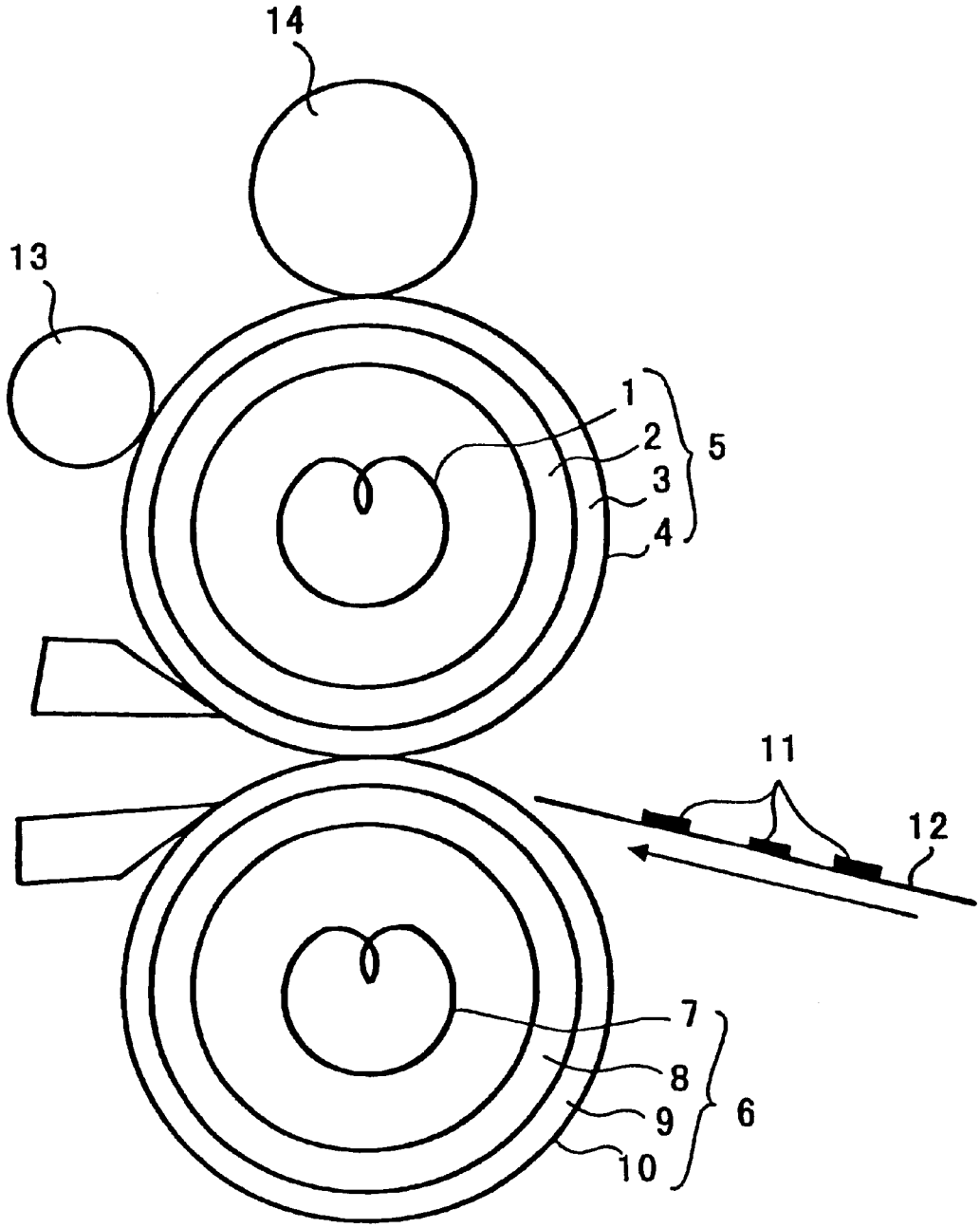
FIG. 1 PRIOR ART
FIG. 1 is a schematic view illustrating a heat roller fixing device as an example of background art.
Figure 2:
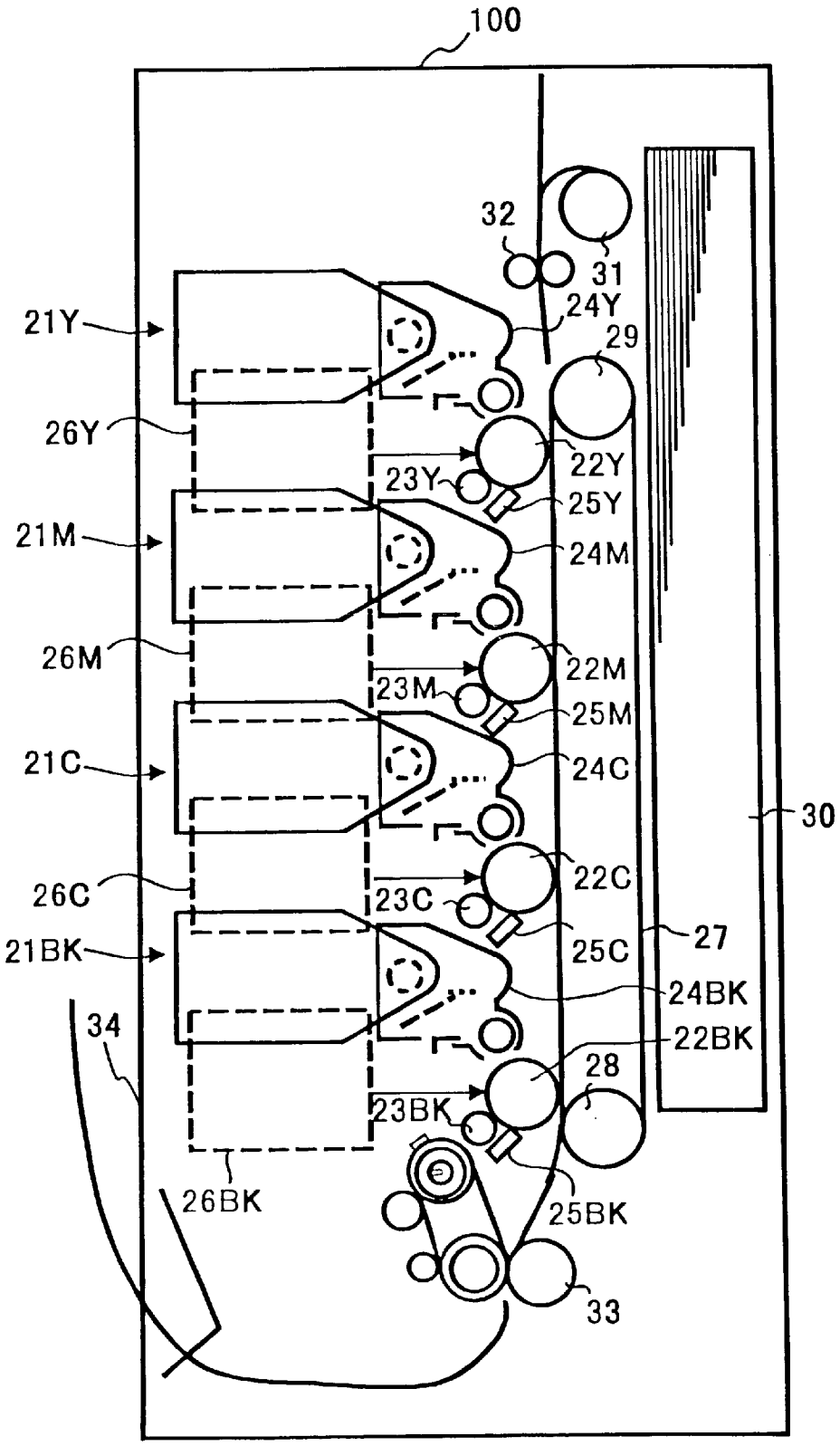
FIG. 2 is a schematic view illustrating an image forming apparatus as an example configured according to the present invention.

Referring now to the drawings, wherein like reference numerals designate identical or corresponding parts throughout the several views, and more particularly to FIG. 2 thereof, an image forming apparatus 100 as an example configured according to the present invention is illustrated. The image forming apparatus 100 includes a yellow toner image forming unit 21Y, a magenta toner image forming unit 21M, a cyan toner image forming unit 21C, and a black toner image forming unit 21Bk.

The image forming units 21Y, 21M, 21C, and 21Bk form yellow, magenta, cyan, and black toner images, respectively, to generate a full color image. The image forming units 21Y, 21M, 21C, and 21Bk include photoconductive drums 22Y, 22M, 22C, and 22Bk as image carriers, and contact charging rollers 23Y, 23M, 23C, and 23Bk as electrical charging devices, respectively. The image forming units 21Y, 21M, 21C, and 21Bk also include developing devices 24Y, 24M, 24C, and 24Bk, drum cleaning devices 25Y, 25M, 25C, and 25Bk, and exposure devices 26Y, 26M, 26C, and 26Bk, respectively. As photoconductive drums 22Y, 22M, 22C, and 22Bk, for example, metal drums coated with organic photoconductive material can be utilized.

Each of the photoconductive drums 22Y, 22M, 22C and 22Bk is rotated by a motor clockwise, and residual electrical charge on each of the photoconductive drum surfaces is discharged by irradiation of light of a discharging device such as a light emitting diode, for canceling and normalizing a previous image forming history. Then the contact charging rollers 23Y, 23M, 23C, and 23K charge the photoconductive drums 22Y, 22M, 22C, and 22Bk at a substantially uniform voltage, respectively, and the exposure devices 26Y, 26M, 26C, and 26Bk irradiate the charged photoconductive drums 22Y, 22M, 22C, and 22Bk with laser scanning light beams according to image signals. Each of the image signals corresponds to each color toner image to be formed. Thus, electrostatic latent images corresponding to respective colors are formed on the photoconductive drums 22Y, 22M, 22C, and 22Bk. After that, the developing devices 24Y, 24M, 24C, and 24Bk develop the electrostatic latent images on the photoconductive drums 22Y, 22M, 22C, and 22Bk with respective color toners, and thereby color toner particles are attracted and adhered to the photoconductive drums 22Y, 22M, 22C, and 22Bk. Thus, yellow, magenta, cyan, and black toner images are formed on the photoconductive drums 22Y, 22M, 22C, and 22Bk, respectively.

The image forming apparatus 100 also includes a transport and transfer belt 27 spanned around a driving roller 28 and a tightening roller 29. The transport and transfer belt 27 is rotated counterclockwise by a motor via the driving roller 28 for transporting an image transfer sheet. Meanwhile, a sheet feed device 30 loads sheets of papers as image transfer sheets, and a sheet feed roller 31 feeds out the top sheet from the sheet feed device 30 one by one toward a register roller 32. The register roller 32 stops the fed sheet and further transports the sheet to the transport and transfer belt 27 in synchronization with the leading edge of the toner images formed on the photoconductive drums 22Y, 22M, 22C, and 22Bk. The toner images on the photoconductive drums 22Y, 22M, 22C, and 22Bk are transferred one after another to the image transfer sheet being transported on the transport and transfer belt 27 by appropriate image transfer devices, such as corona discharging devices. Thus, the yellow, magenta, cyan, and black toner images are overlaid on the image transfer sheet to form a full color image. The image transfer sheet carrying the overlaid toner images is then separated from the transport and transfer belt 27, and the separated sheet is transported to a fixing device 33. The fixing device 33 softens or melts the overlaid toner images with heat and pressure and fixes the overlaid toner image onto the image transfer sheet. Then, the fixing device 33 discharges the sheet carrying the fixed toner image as a permanent full color image to an exit tray 34.

After the transport and transfer belt 27 has released the image transfer sheet to the fixing device 33, a belt cleaning device removes residual paper dust and toner particles on the transport and transfer belt 27 in preparation for the following image forming process. Further, the drum cleaning devices 25Y, 25M, 25C, and 25Bk remove residual toner particles and paper dust on the photoconductive drums 22Y, 22M, 22C, and 22Bk also in preparation for the following image forming process.

Figure 3:
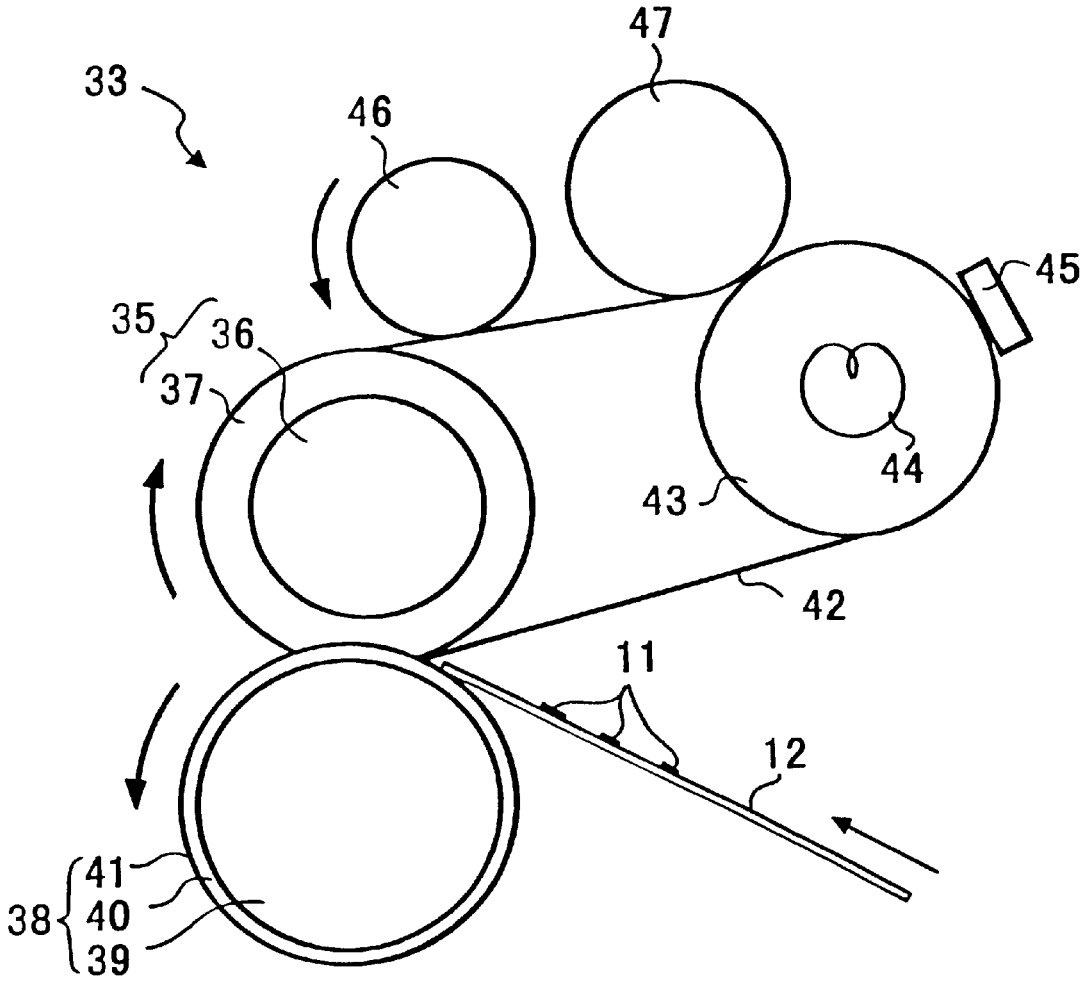
FIG. 3 is a schematic view illustrating a fixing device as an example configured according to the present invention.

FIG. 3 is a schematic view illustrating a fixing device 33 as an example configured according to the present invention. Referring to FIG. 3, the fixing device 33 includes a fixing roller 35, a backup roller 38, an endless fixing belt 42, a heat roller 43, a halogen heater 44 as a heat source, a temperature detecting device 45, a cleaning roller 46, and an oil coating roller 47. The fixing roller 35 includes an elastic layer 37 on a metal core 36. In this example, the outside diameter of the fixing roller 35 is approximately 30 millimeters, and the elastic layer 37 is structured of silicone rubber foam having a thickness of approximately 7 millimeters.

The backup roller 38 includes a metal core 39, an elastic layer 40 on the metal core 39, and a release agent layer 41 as the outermost layer. In this example, the outside diameter of the backup roller 38 is also approximately 30 millimeters, and the elastic layer 40 is structured of solid silicone rubber having a thickness of approximately 1 millimeter. The release agent layer 41 is structured of a Perfloro Alchoxy resin (PFA) tube. As described, the thickness of the elastic layer 40 is much thinner than that of the elastic layer 37, and therefore the circumferential hardness of the backup roller 38 is considerably harder than the circumferential hardness of the fixing roller 35.

The endless fixing belt 42 is spanned around the fixing roller 35 and the heat roller 43. The heat roller 43 provides appropriate tension for the endless fixing belt 42. In this example, the endless fixing belt 42 is structured by a seamless nickel belt having an approximately 40 micrometer thickness coated with a release silicone layer as a release agent of approximately 150 micrometer thickness. As a substrate, a metal sheet other than nickel or heat-resistant plastics, such as polyimide film may also be used. The halogen heater 44 as a heat source is disposed outside the fixing roller 35, and inside the heat roller 43.

The halogen heater 44 heats the heat roller 43, and the heat of the heat roller 43 is then transferred to the endless fixing belt 42. When an image transfer sheet 12 carrying a toner image 11 is fed into the nip formed between the fixing belt 42 and the backup roller 38, the heated fixing belt 42 and the backup roller 38 sandwich and transport the image transfer sheet 12. Consequently, the toner image 11 is applied with heat and pressure by the fixing belt 42 and the backup roller 38, and thereby the toner image 11 is softened or melted, and fixed onto the image transfer sheet 12.

The fixing device 33 is thus structured to reach to a ready-to-fix state or ready-to-fix temperature from room temperature in a relatively short time, for example, within one minute, which is shorter in comparison with a conventional color image fixing device, which may require five minutes. In other words, the image forming apparatus 100 can quickly come to a ready-to-use state after the power is turned on.

The temperature detecting device 45 detects the temperature of the endless fixing belt 42 at a circumferential position of the heat roller 43 and transmits the detected temperature to a temperature control device (not shown). The temperature control device controls supplying current to the halogen heater 44 according to the detected temperature such that the temperature of the endless fixing belt 42 is maintained in a predetermined range of temperature.

The cleaning roller 46 contacts the endless fixing belt 42 and removes paper dust, toner particles, and other particles from the endless fixing belt 42. The oil coating roller 47 also contacts the endless fixing belt 42 and applies oil as a release agent to the endless fixing belt 42.

Figure 4A:
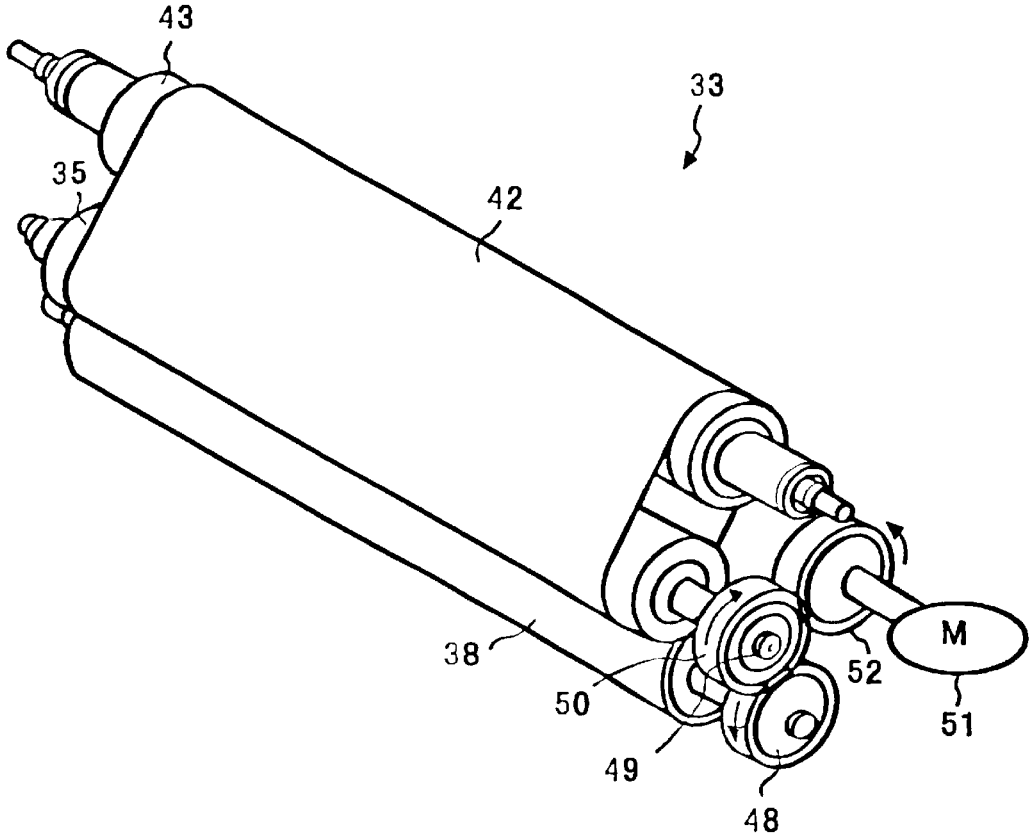
FIGS. 4A and 4B are perspective views illustrating the fixing device of FIG. 3.
Figure 4B:
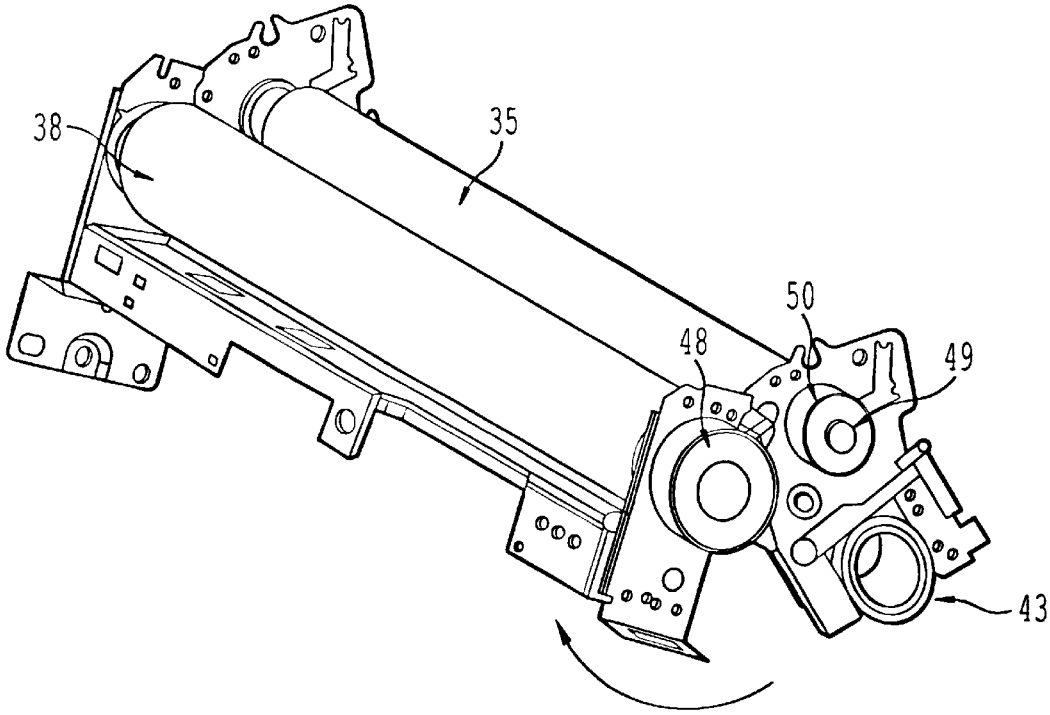

FIGS. 4A and 4B are perspective views illustrating the fixing device 33 of FIG. 3. With reference to FIGS. 4A, 4B, a first gear 48 is coaxially and tightly mounted on the shaft of the roller having the harder circumferential surface, i.e., on the backup roller 38 in this example. A one-way clutch 49 is coaxially mounted around the shaft of the roller having the softer circumferential surface, i.e., on the fixing roller 35 in this example, and a second gear 50 is coaxially fixed to the one-way clutch 49. Therefore, the fixing roller 35, having the softer circumferential surface in this example, is rotated only in one direction by driving the second gear 50 via the one-way clutch 49.

Both of the first gear 48 and the second gear 50 are spur gears and have 27 teeth of module one tooth profile. The first gear 48 and the second gear 50 engage each other during toner image fixing operations. The second gear 50 on the fixing roller 35 engages a third gear 52 mounted on the shaft of a motor 51, which is disposed in the main body of the image forming apparatus 100. Accordingly, the rotating torque of the motor 51 is transmitted from the third gear 52 to the second gear 50, and is then transmitted to the fixing roller 35 via the one-way clutch 49. Thus, the fixing roller 35 is rotated. The rotating torque of the motor 51 is also transmitted to the backup roller 38 via the third gear 52, the second gear 50, and the first gear 48, and thus the backup roller 38 is rotated.

The fixing device 33 is detachable from the main body of the image forming apparatus 100 for a maintenance operation thereof, as shown in FIG. 4B. A rocking motion for a maintenance operation, a clear jam operation, etc. can open the backup roller 38 including the first roller 48. When the backup roller 38 is closed, the backup roller 38 presses the endless fixing belt 42 against the fixing roller 35 by action of a pressure mechanism, and the first gear 48 and the second gear 50 engage each other. As stated above, driving torque is transmitted from the third gear 52 to the second gear 50 on the axis of the fixing roller 35, which does not rock, i.e., is stationary, and therefore the engagement of the third gear 52 and the second gear 50 can be precisely achieved and the driving torque can be smoothly transmitted. Thus, fluctuation of transmitting torque, which may be referred to as jitters, is reduced and degradation of an image caused by such fluctuating torque transmissions, for example, banding images, is reduced.

Referring back to the example of FIG. 3, the fixing roller 35 has a softer circumferential surface; therefore the circumferential surface of the fixing roller 35 is substantially distorted so that the nip between the fixing roller 35 and the backup roller 38 has a large width. Accordingly, even if the temperature of the fixing belt 42 is relatively low; the toner image 11 on the image transfer sheet 12 can be sufficiently heated by passing through such a relatively wide nip. Because the toner image 11 is fixed onto the image transfer sheet 12 with a relatively low temperature, the time needed to reach the ready-to-fix state from a room temperature is shortened.

In addition, because the temperature of the fixing belt 42 is relatively low, a quantity of toner particles transferred from the image transfer sheet 12 to the fixing belt 42 is reduced. As one reason for the phenomena, as the temperature of toner particles is low, an adhesive force of the toner particles is also low to the silicone rubber, i.e., the surface of the fixing belt 42. Thus, a quantity of the release agent, e.g., oil applied by the oil coating roller 47, can be omitted or reduced. As a result, presence of a sludge-like mixture can also be reduced.

In general, when an angular velocity of a driving roller is constant, the radius of the driving roller affects a linear transporting velocity of an image transfer sheet under a toner image fixing operation. Referring to FIG. 3, the fixing roller 35 has a softer circumferential surface in comparison with the backup roller 38, and therefore the circumferential surface of the fixing roller 35 is more distorted than that of the backup roller 38, i.e., a radius of the fixing roller 35 varies depending on the angular position of the fixing roller 35. The radius of the fixing roller 35 may also vary depending on a variation in the hardness of the elastic layer 37. Further, the radius of the fixing roller 35 may vary depending on the temperature thereof due to the thermal expansion of the relatively thick elastic layer 37, which has a relatively high thermal expansion coefficient.

On the other hand, as illustrated in FIG. 3, the backup roller 38 is much less distorted, and a change of its radius due to the thermal expansion of the backup roller 38 is relatively small because of the thin elastic layer 40. Therefore, when the backup roller 38 is rotated in a substantially constant angular velocity, the image transfer sheet 12 is also transported at a substantially constant linear velocity.

In this example, the radius of the fixing roller 35 is set to be a little smaller than the radius of the backup roller 38 at the nip therebetween during a toner image fixing operation. Further, as described above, the fixing roller 35 is driven through the one-way clutch 49. Consequently, the backup roller 38 usually transports the image transfer sheet 12, and the friction between the surface of the backup roller 38 and the surface of the fixing roller 35 drives the fixing roller 35 while sandwiching the image transfer sheet 12. So to speak, the backup roller 38 functions as a main drive roller for the image transfer sheet 12.

When the fixing roller 35 does not track the circumferential velocity of the backup roller 38 due to, for example, a disturbance exceeding the above-described friction, the one-way clutch 49 engages the shaft of the fixing roller 35. The rotating torque of the motor 51 is thus transmitted to the fixing roller 35 via the third gear 52, the second gear 50, and the one-way clutch 49. That is, the circumferential velocity of the fixing roller 35 is maintained at substantially the same as or a little bit less than the circumferential velocity of the backup roller 38.

Accordingly, the transportation of the image transfer sheet 12 is not effected much by such a disturbance, and thereby the transportation of the image transfer sheet 12 is smoothly carried on at a substantially constant velocity for a relatively long period. In addition, the fixing device 33 reduces the image transfer sheet 12 becoming crinkled because of zero or little circumferential velocity difference between the rollers 35, 38. Further, the fixing device 33 increases the life of the elastic layer 37 of the fixing roller 35 because of a relatively small stress imposed on the elastic layer 37.

Figure 5:
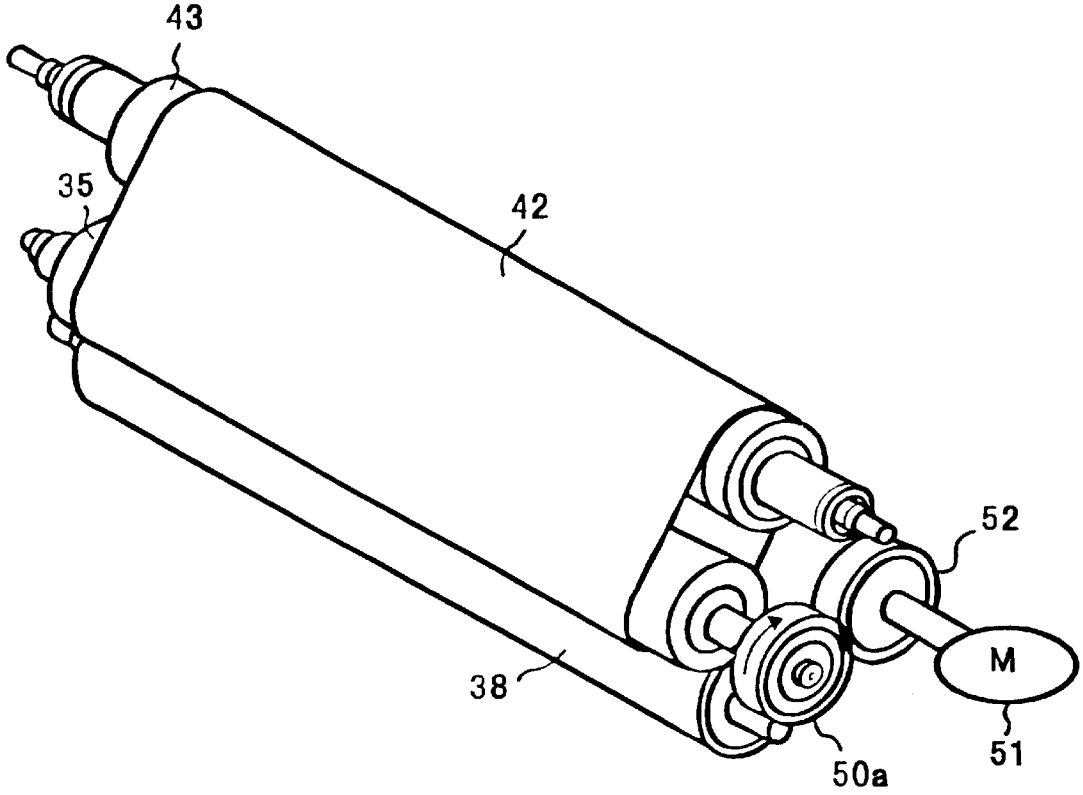
FIG. 5 is a perspective view illustrating a fixing device configured for an experiment.

FIG. 5 is a perspective view illustrating a fixing device configured for an experiment. In FIG. 5, the elements that are substantially the same as those in FIG. 4 are denoted by the same reference numerals, and a description of those elements is not provided. Referring to FIG. 5, the fixing device of FIG. 5 provides a gear 50*a* fixed to the axis of the fixing roller 35 and engaged to the third gear 52 on the shaft of the motor 51. Driving torque of the motor 51 is transmitted to the fixing roller 35 via the third gear 52 and the gear 50*a*. Only friction at the nip portion between the fixing roller 35 and the backup roller 38 rotates the backup roller 38. Therefore, the backup roller 38 sometimes tends to be retarded by an external large disturbance due to sliding at the nip portion.

Figure 6:
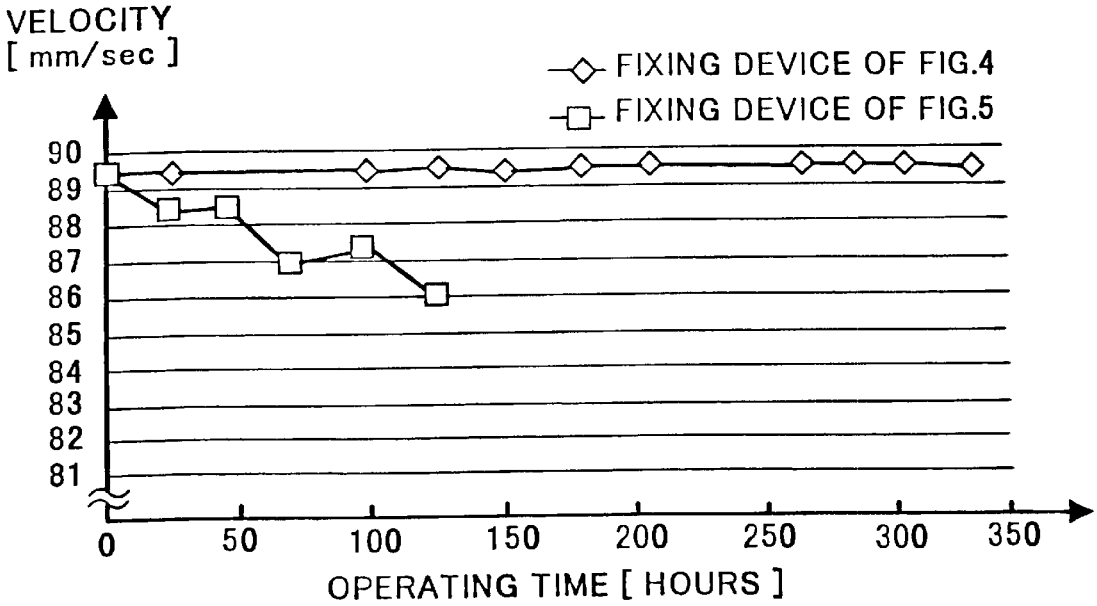
FIG. 6 is a graph illustrating a relationship between an operating time and velocities of fixing devices.

FIG. 6 is a graph illustrating a relationship between an operating time and the velocity of an image transfer sheet carried by a fixing device. In FIG. 6, the data marked by small diamonds had been generated by an experiment using the fixing device 33 of FIG. 4, and the data marked by large squares had been generated by an experiment using the fixing device of FIG. 5. In both experiments, the initial velocities had been set at approximately 89.5 millimeters/second. As illustrated in FIG. 6, the velocity of the fixing device of FIG. 5 varied as the operating time went on. On the other hand, the velocity of the image transfer sheet by the fixing device 33 of FIG. 4 maintained substantially a constant velocity for a relatively long operating time of as much as 350 hours, in comparison with the fixing device of FIG. 5.

As described above, in the fixing device 33 of FIG. 4, the backup roller 38 functions as a primary driving roller, and the fixing roller 35 is driven by both of the friction caused by the backup roller 38 and the one-way clutch 49 and the gear train connected to the motor 51. On the other hand, in the fixing device of FIG. 5, the fixing roller 35 functions as a primary driving roller, and the backup roller 38 is driven only by the friction caused by the fixing roller 35. Therefore, in the fixing device of FIG. 5, the elastic layer 37 of the fixing roller 35 is loaded with relatively large driving torque for driving the backup roller 38. Particularly, as the elastic layer 37 of the fixing roller 35 is thick and soft, the elastic layer 37 tends to be degraded and the transportation velocity of the image transfer sheet tends to be deviated from the initial velocity as illustrated in FIG. 6.

In the examples of FIG. 4 and FIG. 5, the hardness of the elastic layer 37 of the fixing roller 35 is equal to or smaller than 40 degrees by Physical Testing Method for Expanded Rubber SRIS 0101-1968 defined and standardized by the Japan Rubber Association. For testing the hardness of the elastic layer 37, as an example, an analog durometer type Asker C that is manufactured by KOBUNSHI KEIKI Co. Ltd. may be used.

When a fixing roller 35 having such a soft elastic layer 37 had been examined in the fixing device of FIG. 5, the fixing roller 35 had been deteriorated in a relatively short operating period of time, such as 150 hours. However, when a fixing roller 35 having substantially an identical soft elastic layer 37 had been examined in the fixing device 33 of FIG. 4, the fixing roller 35 had not been practically deteriorated in the same period in addition to providing the transportation stability stated above.

Because the elastic layer 37 of the fixing roller 35 is structured by such a soft material, i.e., 40 degrees or smaller, a wide nip as much as 10 millimeters between the fixing roller 35 and the backup roller 38 is obtained by applying a relatively small pressure against the fixing roller 35.

Referring back to FIG. 3, as an effect of the wide nip of the fixing device 33 of FIG. 4, a fixing temperature range, in which the toner image 11 is fixed onto the image transfer sheet 12, is extended. As another effect of the wide nip of the fixing device 33, a fixing temperature can be lowered. Since the fixing temperature can be lowered, a time period required to go from room temperature to the ready-to-fix state can be shortened. Because the fixing temperature can be lowered, the quantity of oil as a release agent being applied to the endless fixing belt 42 is reduced. Further, because the pressure on the image transfer sheet 12 applied at the nip between the fixing roller 35 and the backup roller 38 is relatively small, the image transfer sheet 12 does not tend to become crinkled.

In general, heat resistance of a thick soft elastic layer of a fixing roller is large, and if a heat source is disposed inside the fixing roller, a time period required to go from room temperature to a ready-to-fix state tends to be large. However, in the fixing device 33 of FIG. 4, the halogen heater 44 as a heat source is disposed to heat the endless fixing belt 42, which has a relatively small heat mass, via the heat roller 43. Therefore, a time period required to go from room temperature to the ready-to-fix state is shortened in comparison with a fixing device providing a heat source disposed inside a fixing roller covered with a thick soft elastic layer.

In the above-described fixing device 33, the rotating torque generated by the motor 51 is transmitted to the second gear 50 by the third gear 52, and is then transmitted to the first gear 48. However, the third gear 52 of the motor 51 may also be directly engaged to the first gear 48.

Further, the relation of the hardness between the fixing roller 35 and the backup roller 38 may be exchanged, i.e., the backup roller 38 may have a softer circumferential hardness than the fixing roller 35. When the backup roller 38 has a softer circumferential hardness than the fixing roller 35, the one-way clutch 49 may be removed from the shaft of the fixing roller 35, and a one-way clutch is installed between the axis of the backup roller 38 and the first gear 48. In this case, the third gear 52 of the motor 51 may also be engaged to either the first gear 48 or the second gear 50.

Figure 7:
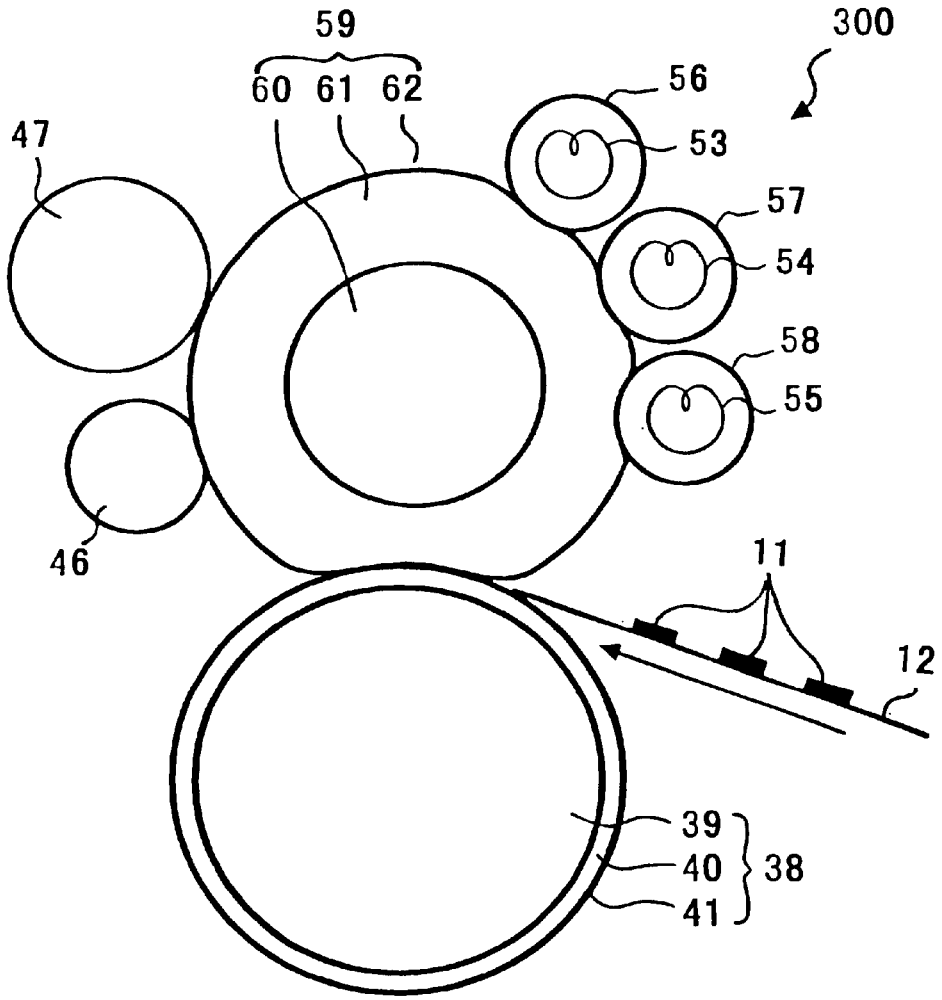
FIG. 7 is a schematic view illustrating a fixing device as another example configured according to the present invention.

FIG. 7 is a schematic view illustrating a fixing device 300 as another example configured according to the present invention. Referring to FIG. 7, the fixing device 300 includes a fixing roller 59, a backup roller 38, a first heat source 53, a second heat source 54, a third heat source 55, a first heat roller 56, a second heat roller 57, a third heat roller 58, a temperature detecting device 45, a cleaning roller 46, and an oil coating roller 47.

The fixing roller 59 includes an elastic layer 61 on a metal core 60 and a release silicone layer 62. Between the release silicone layer 62 and the elastic layer 61, a fluororubber layer may be added for preventing swelling of the elastic layer 61 caused by release agent oil. The hardness of the elastic layer 61 of the fixing roller 59 is equal to or less than 40 degrees by Physical Testing Method for Expanded Rubber SRIS 0101-1968 defined and standardized by the Japan Rubber Association.

The first, second, and third heat rollers 56, 57, and 58 are made of, for example, an aluminum alloy pipe, and have a thickness of one millimeter. Each of the first heat source 53, the second heat source 54, and the third heat source 55 is disposed in each of the first, second and third heat rollers 56, 57, and 58, respectively. The heat sources 53, 54, and 55 heat the heat rollers 56, 57, and 58, and all the heat rollers 56, 57, and 58 heat the fixing roller 59. Aluminum alloy of the heat rollers 56, 57, and 58 has high heat conductivity, so that the temperature of the fixing roller 59 is rapidly raised and the temperature distribution of the fixing roller 59 along the axis thereof is leveled. The temperature leveling function for the fixing roller 59 along the axis thereof advances a uniform gloss of a fixed toner image.

As illustrated, because the fixing roller 59 includes the thick soft elastic layer 61, the width of the nip between the fixing roller 59 and the backup roller 38 is relatively large. Therefore, the fixing device 300 also has effects of lowering the fixing temperature, shortening of the time period required to go from room temperature to the ready-to-fix state, etc., similarly as discussed above with respect to the fixing device 33 of FIG. 3. Further, the heat sources 53, 54, and 55 are not disposed inside the fixing roller 59, but are disposed in proximity to the outer circumference of the fixing roller 59, and therefore the time period required to reach the ready-to-fix state is further reduced.

Figure 8:
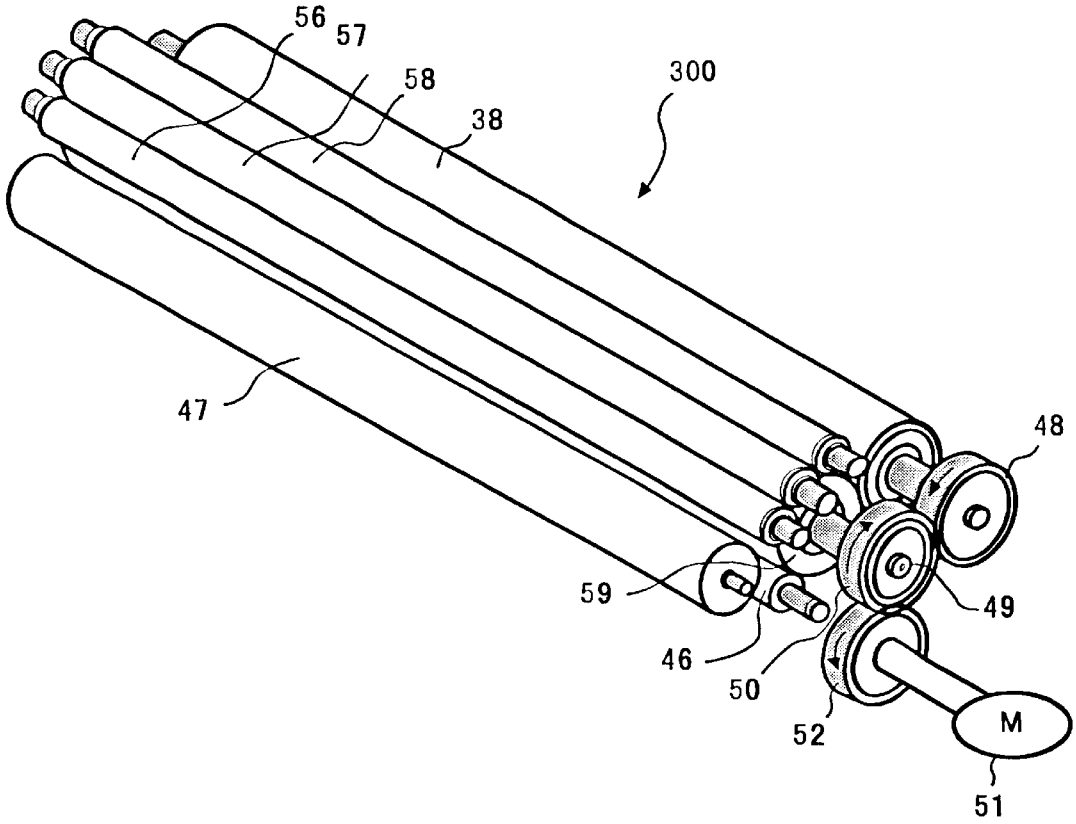
FIG. 8 is a perspective view illustrating the fixing device of FIG. 7.

FIG. 8 is a perspective view illustrating the fixing device 300 of FIG. 7. With reference to FIG. 8, a first gear 48 is coaxially and tightly fixed to the shaft of a roller having a harder circumferential surface, i.e., to the backup roller 38 in this example. A one-way clutch 49 is coaxially mounted around the shaft of a roller having a softer circumferential surface, i.e., to the fixing roller 59 in this example, and a second gear 50 is coaxially fixed to the one-way clutch 49. The second gear 50 on the fixing roller 59 engages a third gear 52 mounted on the shaft of a motor 51, which is disposed in the main body of the image forming apparatus 100.

With the fixing device 300 thus structured, the rotating torque of the motor 51 is transmitted to the third gear 52, transmitted to the second gear 50, and then transmitted to the fixing roller 59 via the one-way clutch 49, and thereby the fixing roller 35 is rotated. The rotating torque of the motor 51 is also transmitted to the backup roller 38 via the third gear 52, the second gear 50, and the first gear 48, and thus the backup roller 38 is rotated.

In this example, the radius of the fixing roller 59 is set to be a little less than that of the backup roller 38 at the nip therebetween during an image fixing operation. Further, as described above, the radius of the fixing roller 59 is driven through the one-way clutch 49. Consequently, the image transfer sheet 12 is usually transported by the backup roller 38, and the fixing roller 59 is driven by friction between the surface of the backup roller 38 and the surface of the fixing roller 59 while sandwiching the image transfer sheet 12. When the fixing roller 59 does not track the velocity of the backup roller 38 by, for example, a disturbance exceeding the above-described friction, the rotating torque of the motor 51 is transmitted to the fixing roller 59 via the third gear 52, the second gear 50, and the one-way clutch 49.

Thus, the transportation of the image transfer sheet 12 is not effected by such a disturbance, and thereby the transportation is smoothly continued in a substantially constant velocity for a relatively long period of time. In addition, the fixing device 300 reduces the image transfer sheet 12 becoming crinkled. Further, the fixing device 300 increases the life of the elastic layer 61 and the release silicone layer 62 of the fixing roller 59.

The fixing device of the present invention is not limited to full color photocopiers, but can also be applied to laser printers, black and white photocopiers, plain paper facsimiles, optical printers such as LED printers, etc.

As described above, the novel image forming apparatus and novel fixing device can fix toner images on an image transfer sheet without release agent or with a relatively small quantity of release agent.

Further, the novel image forming apparatus and novel fixing device can decrease an image transfer sheet from becoming crinkled.

Furthermore, the novel image forming apparatus and novel fixing device can reach the ready-to-fix state in a relatively short time.

Obviously, numerous additional modifications and variations of the present invention are possible in light of the above teachings. For example, features described for certain embodiments may be combined with other embodiments described herein. It is therefore to be understood that within the scope of the appended claims, the present invention may be practiced otherwise than as specifically described herein.

This document is based on Japanese patent application No. 11-208686 filed in the Japanese Patent Office on Jul. 23, 1999, the entire contents of which are hereby incorporated herein by reference.

What is claimed is:

1. An image forming apparatus comprising:

a toner image forming device configured to form a toner image;

a toner image transfer device configured to transfer the toner image onto an image transfer member; and a fixing device configured to fix the toner image on the transfer member, wherein the fixing device comprises:

a fixing roller having an elastic layer at an outer circumference thereof, a backup roller configured to press the image transfer member against the fixing roller, wherein a circumferential hardness of an outer layer of the backup roller is configured to be harder than that of the elastic layer of the fixing roller, a heating device formed outside the fixing roller and the backup roller, a first gear coaxially mounted on the roller having the harder circumferential surface, a one-way clutch coaxially mounted on the other roller, a second gear coaxially mounted on the one-way clutch, wherein the first gear and the second gear are configured to be engaged when the backup roller presses the image transfer member against the fixing roller, and a drive source configured to be engaged with one of the first gear and the second gear, wherein the backup roller and first gear are configured to be opened relative to said fixing roller, the fixing roller being fixed in position, for a maintenance operation.

2. An image forming apparatus according to claim 1, wherein the circumferential hardness of the roller having the softer circumferential surface is softer than a predetermined hardness.

3. An image forming apparatus according to claim 2, wherein the predetermined circumferential hardness is equivalent to 40 degrees by Physical Testing Method for Expanded Rubber ARIS 0101-1968 of the Japan Rubber Association.

4. An image forming apparatus according to claim 1, further comprising:

an endless belt configured to be spanned around a plurality of rollers including the fixing roller.

5. An image forming apparatus according to claim 1, further comprising:

a heating device configured to be disposed outside the fixing roller and to heat an outer circumferential surface of the fixing roller.

6. A fixing device for fixing a toner image on a transfer member comprising:

a first roller configured to have an elastic layer with a first predetermined hardness at an outer circumference thereof;

a heating device configured to heat the toner image on the transfer member;

a second roller configured to contain the heating device;

an endless belt configured to be spanned around the first roller and the second roller;

a third roller configured to have an outer layer with a second predetermined hardness that is harder than the first predetermined hardness of the elastic layer and to press the image transfer member against the endless belt;

a first gear configured to be coaxially mounted on the third roller;

a one-way clutch configured to be coaxially mounted on the first roller;

a second gear configured to be coaxially mounted on the one-way clutch and engaged with the first gear; and a motor configured to drive at least one of the first gear and the second gear, wherein the third roller and first gear are configured to be opened relative to the first roller, the first roller being fixed in position, for a maintenance operation.

7. An image forming apparatus comprising:

means for forming a toner image;

means for transferring the toner image onto an image transfer member; and means for fixing the toner image on the transfer member, wherein the fixing means comprises:

first rotatable means having an elastic layer at an outer circumference thereof for contacting the transfer member, second rotatable means for contacting the transfer member, wherein a circumferential hardness of an outer layer of the second rotatable means is harder than that of the elastic layer of the first rotatable means, heating means formed outside the first rotatable means and the second rotatable means for heating the transfer member, first driven means mounted on the rotatable means having the harder circumferential surface for delivering a driving force to the rotatable means having the harder circumferential surface, one-way driving means mounted on the other rotatable means for allowing rotation in only one direction, second driven means mounted on the one-way driving means, wherein the first driven means and the second driven means for engaging when the second rotatable means presses the image transfer member against the first rotatable means, and drive means for driving one of the first driven means and the second driven means, wherein the second rotatable means and first driven means are configured to be opened relative to the first rotatable means, the first rotatable means being fixed in position, for a maintenance operation.

* * * * *